United States Patent [19]

Kohl

[11] 4,137,734

[45] Feb. 6, 1979

[54] JACQUARD CONTROLLED WARP KNITTING MACHINES AND YARN GUIDE UNITS THEREFOR

[75] Inventor: Karl Kohl, Obertshausen, Fed. Rep. of Germany

[73] Assignee: Karl Mayer Textilmaschinenfabrik GmbH, Obertshausen, Fed. Rep. of Germany

[21] Appl. No.: 795,430

[22] Filed: May 10, 1977

[30] Foreign Application Priority Data

May 15, 1976 [DE] Fed. Rep. of Germany ..... 2621797

[51] Int. Cl.[2] ..... D04B 15/64

[52] U.S. Cl. ..... 66/214

[58] Field of Search ..... 66/214, 207, 125 R

[56] References Cited

U.S. PATENT DOCUMENTS

| | | | |
|---|---|---|---|
| 2,822,679 | 2/1958 | Schoenster | 66/214 |
| 3,066,510 | 12/1962 | Kohl | 66/214 |
| 3,998,074 | 12/1976 | Kohl | 66/214 |

FOREIGN PATENT DOCUMENTS

| | | | |
|---|---|---|---|
| 173134 | 1951 | Austria | 66/214 |
| 672076 | 2/1939 | Fed. Rep. of Germany | 66/214 |

*Primary Examiner*—Wm. Carter Reynolds
*Attorney, Agent, or Firm*—Omri M. Behr

[57] ABSTRACT

There are provided jacquard controlled warp knitting machines equipped with yarn guide units having yarn guides wherein the heads of said yarn guide members are so oriented that, when uninfluenced by the jacquard dropper pins, two or more yarn guide member heads may pass between any predetermined pair of needles on the needle bar of the machine.

4 Claims, 3 Drawing Figures

JACQUARD CONTROLLED WARP KNITTING MACHINES AND YARN GUIDE UNITS THEREFOR

BACKGROUND OF THE INVENTION

It is known, and desirable, to construct jacquard controlled warp knitting machines comprising two yarn guide members which are influenced by the appropriate jacquard droppers. The construction costs of providing the second row of yarn guides is substantial. In machines which additionally utilize drop plates in which the jacquard guide bar must be provided in front of the dropping plate, the provision of a second set of jacquard controlled guides and dropper pins is very complicated since the provision of the thread for the second jacquard guide bar must in every case pass through the first bar.

It is also known to construct warp knitting machines having two sets of yarn guide members on a single guide bar. In these machines, however, the orientation of the thread bearing eyelets of the guides in the uninfluenced condition is separated by a needle space so that in the uninfluenced condition only one guide will pass between any predetermined pair of needles.

It would be most desirable to provide equipment wherein several guide members could pass, at the same time, through the space between any predetermined pair of needles in the jacquard uninfluenced condition or, alternatively, in the influenced position be able to knit across more than one adjacent needle.

SUMMARY OF THE INVENTION

In the present invention, there are provided yarn guide units wherein at least two yarn guide heads may pass, in the jacquard uninfluenced condition, between any predetermined pair of needles on the appropriate needle bar of the warp knitting machine. In the present invention, the head portion of at least one guide member of adjacent guides is displaced laterally, but with its plane parallel to the plane of its shaft portion so that at least two adjacent guide head portions having the thread eyelets in the ends thereof lie in a single plane and are enabled to pass, in the uninfluenced condition, between any predetermined pair of needles. This arrangement permits the use of a single jacquard influenced guide bar influenced by jacqeyelets in the ends thereof lie in a single plane and are enabled to pass, in the uninfluenced condition, between any predetermined pair of needles. This arrangement permits the use of a single jacquard influenced guide bar influenced by jacquard dropper pins to be used in the production of double colored or double threaded jacquard patterns. In this equipment each of the guide members is influenceable to the extent that it is able to make an overlap over one working needle while, at the same time, an underlap is carried out on an adjacent needle.

In a further embodiment of the present invention, the guides are provided in pairs of guide members wherein the distance between the shaft portions of each adjacent guide member is half the distance between any pair of needles. The head portions of the adjacent guide members in a given guide are laterally displaced towards each other so that the head portions lie in a single plane. The distance between adjacent pairs of head portions is equivalent to the distance between adjacent pairs of needles.

In all the foregoing figures, which indicate the at rest position of the yarn guides, said yarn guides are, during the operation thereof in the warp knitting machine, influenced from side J-1 to side J-2 by jacquard dropper pins which contact on side J-1. The dotted line qq in FIG. 1 indicates an arbitrary line of demarcation between the shaft portion of the guide and the central portion, and the dotted line pp indicates an arbitrary line of demarcation between the central portion and the head portion of the guides.

In the discussion of the preferred embodiments set forth hereinbelow, the last two digits of two or three digit numbers indicates the same part or portion of the overall device.

DESCRIPTION OF THE PREFERRED EMBODIMENTS

In all the embodiments of the present invention, there is provided a conventional mounting unit 10. There are also provided a plurality of yarn guides 20. Also illustrated in dotted form are the locations 15 of the needles in the appropriate needle bars 16.

Figure 3:
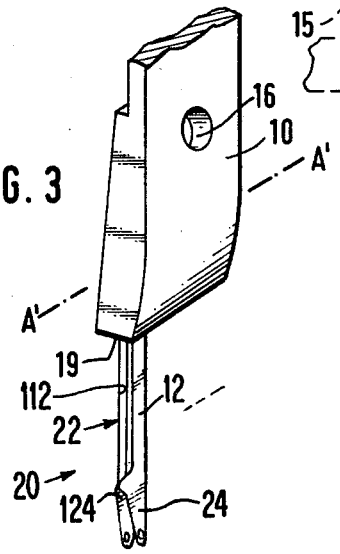
FIG. 3 is a side elevational perspective view of FIG. 2 showing the location of the transverse axis A within the principal plane AA—AA of the mounting units.

The mounting units 10 have a general plane designated AA—AA. Further, FIG. 3 shows a transverse axis A′ of said mounting unit. The transverse axis is an arbitrary line approximate to the mounting hole 16 passing through the mounting unit 10 parallel to edges 17 and 19 which provide between them the face in which the guides 20 are mounted, suitably soldered, in the conventional manner.

Figure 2:
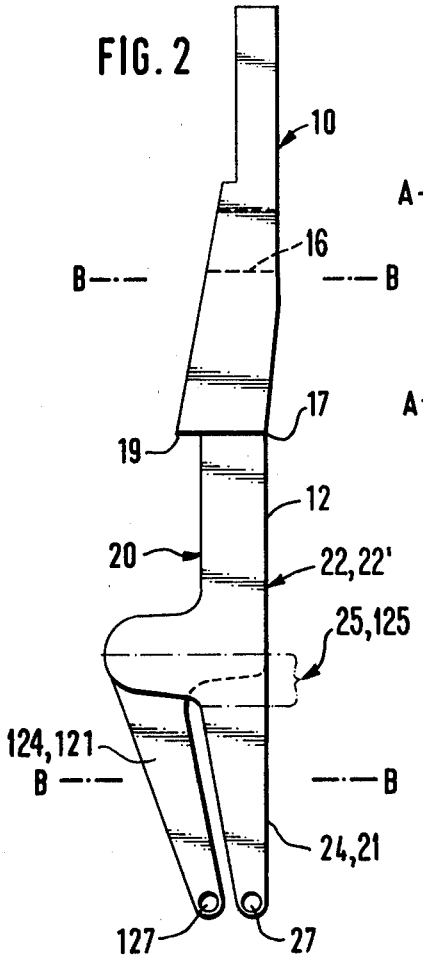
FIG. 2 is a side elevational view of FIG. 1 viewed from 2—2 further including an indication of the plane BB—BB to which the side elevational view of the planes of the face of the yarn guides of the preferred embodiment of the present invention lie parallel.

FIG. 2 further shows an axial plane BB—BB. This is a theoretical plane. In the embodiments shown, the flat elongated head portions 21 and 24 of the yarn guide members 22 and 22′ lie parallel to this plane, the longitudinal axes of the flat elongated head and shaft portions of guide members 22 and 22′ lie parallel to this plane and said plane is perpendicular to the general plane AA—AA of the mounting unit 10.

In the preferred embodiments of the invention the, shaft portion 12 of a guide member 22 is mounted in mounting unit 10 in any given set of guides 20. At least one member 22 thereof has its central portion 25 bent towards an adjacent guide member 22′, and the elongated head portion 24 thereof, having eyelet 27 in the end thereof, oriented with its plane parallel to the shaft portions 12 and 112. Alternatively, member 22′ may have its central portion 125 bent towards an adjacent guide member 22 and the elongated head portion 124 thereof, having eyelet 127 in the end thereof, oriented with its plane parallel to the shaft portions 12 and 112. It will be seen by those skilled in the art that many variations are possible.

Figure 1:
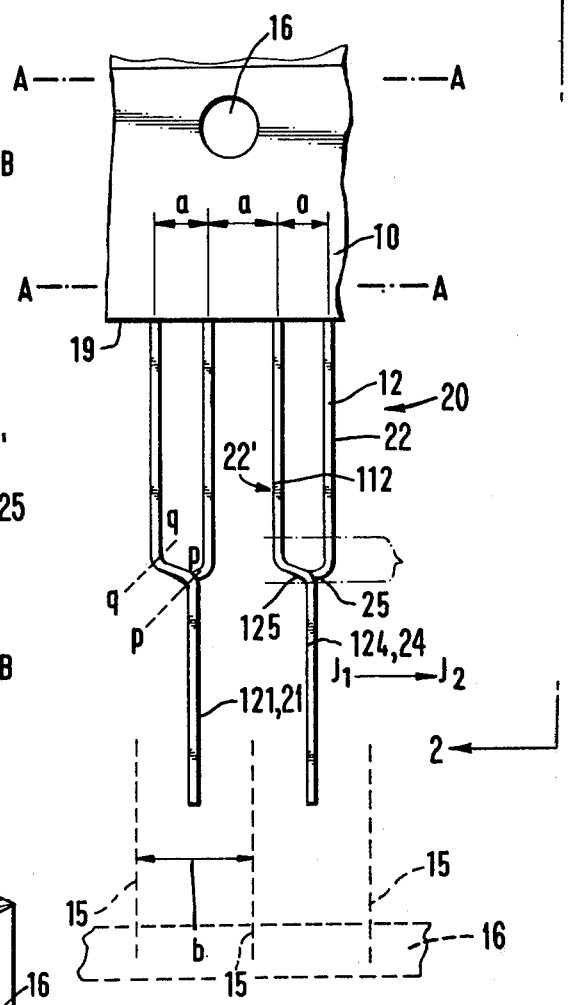
FIG. 1 is a partial plan view of a yarn guide unit showing the alternation of pairs of yarn guides. It further shows the location of the general plane AA—AA of the mounting unit.

In the embodiment shown in FIG. 1, adjacent guides are bent towards each other so that the plane of the elongated head portions 24 and 124 lie in a single plane and said plane lies substantially halfway between the planes on which the respective shaft portions 12 and 112 lie. It is, of course, possible to maintain, say, an entire guide member in a single plane and to displace the head portion 124 of an immediately adjacent guide 22', on one side all the way across the space between the adjacent guide members so that, say, shaft portion 12 (but not shaft portion 112) and head portions 24 and 124 all lie in a single plane.

In a further embodiment a third guide member lying on the other side of the unbent guide member (entire member in a single plane) could be similarly displaced in the full gap amount (space between adjacent guide member) to provide three head portions lying in a single plane. It will, thus, be seen that the invention is not limited to the number of guides members in a yarn guide.

In the especially preferred embodiment of the invention illustrated in FIG. 1, the space between needles 15 in the appropriate needle bed is shown as b. The space between adjacent shaft portions of guide members 22 and 22' is shown as a. The displacement of the head portions 24 and 124 laterally from the corresponding shaft portions 12 and 112 is onehalf a. In this embodiment 2a equals b; thus, the distance between the head portions of adjacent sets of guide members from each other is equal to b and the distance of each head portion from the adjacent shaft portion is onehalf a.

I claim:

1. A yarn guide unit for use in jacquard controlled warp knitting machines comprising:

(a) a mounting unit, said mounting unit having a transverse axis; and, (b) a plurality of unitary yarn guide members each guide member comprising three portions including:

(i) a flat elongated shaft portion lying in a predetermined plane, said shaft portion having a longitudinal axis and being mounted in said mounting unit, the longitudinal axis of said shaft portion being perpendicular to the transverse axis of said mounting unit and lying in a common plane therewith, the planes of the shaft portions of said plurality of guide members being oriented parallel to each other;

(ii) a central portion connected to said flat portion; and, (iii) a flat elongated head portion connected to said central portion, said flat head portion lying in a predetermined plane and having an eyelet in the end thereof farthest from said central portion;

wherein each said guide unit includes at least two guide members, the head portion of at least one guide member of each unit being laterally displaced towards an adjacent member so that the head portion of each guide member is in a plane parallel to the shaft portion of each guide member and all head portions of a guide unit lie in a common plane.

2. The yarn guide unit of claim 1 wherein each said guide unit comprises two guide members, and wherein the head portions of each said guide members are displaced towards each other in such a fashion so that the plane of the head portions of the guide members lie substantially halfway between the planes of the shaft portions of the guide members.

3. A warp knitting machine including yarn guide bars comprising a plurality of yarn guide units in accordance with claim 1 and needle bars, the orientation of said guides relative to said needles being arranged so that each yarn guide unit, having at least two co-planar guide member head portions, is passable through the space between corresponding pairs of needles on the needle bars.

4. A warp knitting machine according to claim 3 wherein said guide unit contains two guide members, the head portion of said guide members being set apart by the same distance as the needles are spaced out on the needle bars and the shaft portion of each guide member being spaced apart from each adjacent guide member by half the distance between adjacent needles on the needle bar.

* * * * *